United States Patent [19]

Bornstein

[11] Patent Number: 4,874,430

[45] Date of Patent: Oct. 17, 1989

[54] COMPOSITE SILVER BASE ELECTRICAL CONTACT MATERIAL

[75] Inventor: Norman S. Bornstein, West Hartford, Conn.

[73] Assignee: Hamilton Standard Controls, Inc., Farmington, Conn.

[21] Appl. No.: 300,399

[22] Filed: Jan. 23, 1989

Related U.S. Application Data

[62] Division of Ser. No. 189,272, May 2, 1988, Pat. No. 4,834,939.

[51] Int. Cl.[4] ..... C22C 29/12

[52] U.S. Cl. ..... 75/234; 419/21; 419/23; 419/30; 419/31; 419/49; 252/513; 252/514; 252/518; 252/519; C22C/29/12

[58] Field of Search ..... 75/232, 234; 419/21, 419/30, 31, 23, 49; 252/513, 514, 518, 519

[56] References Cited

U.S. PATENT DOCUMENTS

| | | | |
|---|---|---|---|
| 4,141,727 | 2/1979 | Shida et al. | 75/232 |
| 4,204,863 | 5/1980 | Schreiner | 75/234 |
| 4,622,269 | 11/1986 | Leung et al. | 419/23 |
| 4,764,227 | 8/1988 | Rothkegel et al. | 75/247 |
| 4,810,289 | 3/1989 | Hoyer et al. | 75/232 |

*Primary Examiner*—Stephen J. Lechert, Jr.
*Attorney, Agent, or Firm*—Charles E. Sohl

[57] ABSTRACT

A silver base electrical contact material is described which contains a dispersion of particles consisting of cadmium oxide and nickel. The nickel particles are surrounded by a continuous adherent coating of nickel oxide which eliminates the detrimental reaction which would otherwise occur between nickel and cadmium oxide. The invention contact materials have improved lives and are fabricated by any one of several different powder metallurgy techniques.

4 Claims, 1 Drawing Sheet

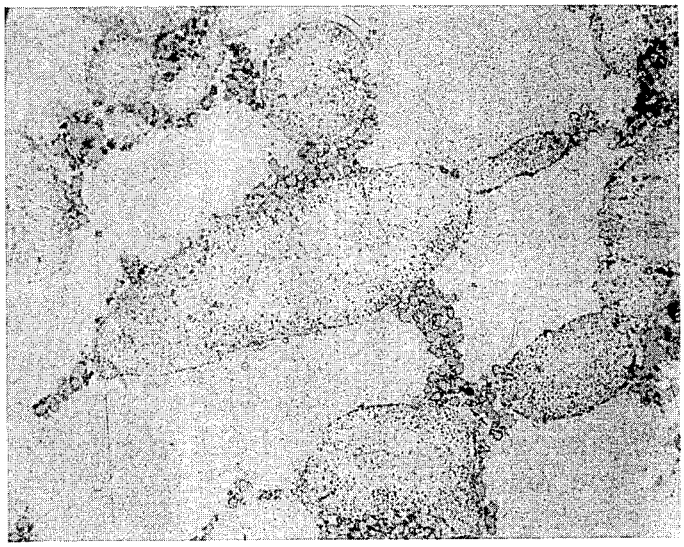
500 X

COMPOSITE SILVER BASE ELECTRICAL CONTACT MATERIAL

DESCRIPTION

This is a division of copending application Ser. No. 189,272 filed May 2, 1989, now U.S. Pat. No. 4,834,939.

1. Technical Field

The present invention relates to the field of electrical contact materials and to methods for producing them.

2. Background Art

Electrical contacts are an important part of many electrical devices such as switches, relays and the like. In a generally used form, two electrically conductive elements are appropriately arranged and adapted to be forced together by an external force. When the conductive articles are in contact they close an electrical circuit permitting the flow of current. When the force is removed the articles are separated thereby interrupting the flow of current. The opening and closing of the contacts causes arcing with deleterious affects on the contacts.

There are a variety of requirements for electrical contacts and no single material meets all requirements for all applications. Generally the requirements include high electrical conductivity to minimize resistive heat generation during current flow, high thermal conductivity to dissipate resistive heat and heat developed during arcing, high resistance to environmental degradation (formation of oxides, nitrides, sulfides, etc.) and resistance to arc related damage (welding and metal transfer). The force required to cause good electrical contact between the materials should be low and the electrical resistance between articles, when in contact, should be low. The melting point of the material should be high to limit arc erosion, metal transfer, and welding, but low enough to minimize rearcing. The vapor pressure should be low to minimize arc erosion and metal transfer. Hardness should be high to provide good wear resistance, but ductility should be adequate for fabrication and to prevent cracking in use. Economic requirements are also obviously inherent.

No contact material has all these properties and a wide variety of contact materials have been developed to meet the requirements of different applications. However, each material is a compromise in some respect or other and there are always demands for improved electrical contact material.

Among metallic contact materials silver is a favored basis metal because it has high electrical conductivity, high heat capacity, and high resistance to detrimental compound formation in service. However, the strength of pure silver is generally inadequate and silver contacts generally contain other constituents for strength and resistance to high temperature deformation, and self welding.

One of the common strengthening constituents added to silver base contacts is cadmium oxide. Cadmium oxide provides strengthening as a dispersed phase and reduces the tendency of contact to weld together. The decomposition temperature of cadmium oxide is approximately the melting point of silver. In use, especially under arcing conditions, the cadmium oxide decomposes in an endothermic reaction which absorbs much of the energy which would otherwise go to evaporating the silver matrix. Because of this cadmium oxide is a common well regarded addition.

Nickel is another addition, which because of its essential insolubility in silver, is present as a particle dispersion in a silver matrix. Nickel provides resistance to mechanical deformation and improves anti-welding properties. Trace amounts of nickel which may be dissolved in the silver are also believed to embrittle the oxide layer formed on silver contacts making it easier to disrupt and therefore less likely to interfere with the flow of electrical current.

It is observed that while cadmium oxide containing silver contacts display good initial performance the rate of degradation accelerates with the number of contact cycles. A inverse effect is noted with nickel strengthened silver contacts.

It would therefore seem that a combination of nickel and cadmium oxide would produce an improved silver base contact material, but because nickel oxide has a greater negative free energy of formation than cadmium oxide, when nickel and cadmium oxide are both present there would be a tendency for the cadmium oxide to be reduced by the nickel with the attendant formation of nickel oxide. Cadmium forms a solid solution in silver and has a pronounced negative effect on conductivity. Reducing the conductivity increases the resistive heating which will accelerate the contact degradation.

It is an object of the present invention to provide an improved silver base contact material which contains both cadmium oxide and nickel, which is stable over long periods of severe use and which displays improved properties over contacts containing cadmium oxide or nickel alone.

DISCLOSURE OF INVENTION

According to the present invention silver base contacts containing both cadmium oxide and pure nickel dispersions are formed using powder metallurgy techniques. Fine nickel powder is preoxidized to produce a controlled thickness layer of nickel oxide completely surrounding each nickel particle. The nickel oxide is an effective diffusion barrier which prevents the interaction between cadmium oxide and nickel which would otherwise occur in service.

Various powder metallurgy techniques may be used to fabricate the invention contacts, a preferred fabrication processing sequence includes hot isostatic pressing to produce contacts of full theoretical density without porosity and without the necessity of sintering aids such as are now commonly used.

The foregoing and other features and advantages of the present invention will become more apparent from the following description and accompanying drawing.

BRIEF DESCRIPTION OF DRAWING

The drawing is a 500X photomicrograph of material produced according to the invention.

BEST MODE FOR CARRYING OUT THE INVENTION

The present invention is a silver base electrical contact material containing strengthening dispersions of cadmium oxide and nickel. The dispersed nickel particles are surrounded by a layer of nickel oxide which serves as a diffusion barrier preventing interaction between the nickel and cadmium oxide. The cadmium oxide and nickel particles are located in a silver matrix. Cadmium oxide is present from about 4 to about 15 wt. % and the nickel is present from about 2 to about 8 wt. %. Preferred limits for cadmium oxide are 6 to 12 wt. % and for nickel 2 to 6 wt. %. Preferably there is a correlation between cadmium oxide and nickel contents so that amounts of cadmium oxide towards the upper end of the composition range are preferably with nickel contents in the upper end of the nickel range. In the present description the weight change resulting from nickel oxidation is ignored because it is negligible.

Cadmium oxide particles are preferably formed by internal oxidation of silver cadmium alloy and when formed by internal oxidation have a particle size which is less than about 0.5 micron. Cadmium oxide can also be added in the form of a powder to a silver matrix and in this case the cadmium oxide particles would have a range of from about 0.2 micron to about 2 microns, that being dictated primarily by the commercial availability of fine cadmium oxide powder. The nickel constituent is added as a separate powder constituent and will have a range of from about 1 to about 4 microns average particle size, again this is dictated by the availability of nickel powder.

The invention contacts are made by powder metallurgy processes and there are at least seven variations of powder processing which can be used to produce the invention contacts. These processes have different benefits and detriments and any of them may be appropriate for use in particular situations. In all fabrications techniques to be described herein the nickel powder is preoxidized to form a thin continuous adherent nickel oxide layer on the powder particle surfaces, the processing details for this step will be described below. In all processing schemes the constituent quantity and compositions are adjusted so that the final overall composition falls within the previously described limits.

Two fabrication techniques rely on a mixture of starting powders which includes silver cadmium alloy powder and a preoxidized nickel powder. For the first two processing techniques a silver cadmium alloy containing cadmium can be mixed with nickel powder. According to one processing variation the silver cadmium powder can be internally oxidized prior to mixing with the nickel oxide powder. This prior internal oxidation step will convert the cadmium constituent into a fine dispersion of cadmium oxide particles. The second processing variation is to compact the silver cadmium alloy powder with the nickel powder and to internally oxidize the compact. The first processing sequence (wherein the silver cadmium is preoxidized prior to mixing and compaction) will establish a finer more uniform cadmium oxide dispersion in a much shorter time period because the silver cadmium powder particles have a greater surface area and a smaller diffusion distance than the compact which would be internally oxidized in the second processing scheme.

The third and fourth processing schemes parallel the first and second schemes using mixtures of pure silver powder, silver cadmium alloy powder and preoxidized nickel powder. In the third scheme the silver cadmium powder would be preoxidized in the fourth scheme the powders would be compacted then internally oxidized. In this pair of processing sequences the resultant matrix would contain regions of pure silver resulting from the presence of pure silver powder. This can be beneficial especially with respect to soldering or brazing the contacts onto supporting members. The free silver powder is more readily wet by solder or braze material than the silver containing cadmium oxide particles. Other than the presence of free silver and the resultant increase in the cadmium level in the silver cadmium alloy powder to produce the same amount of cadmium oxide particles, the third and fourth processing schemes parallel the first and second. Currently, the third scheme appears to be preferred.

The fifth processing scheme involves a mixture of silver oxide powder, silver cadmium alloy powder and preoxidized nickel particles which can all be put into a container and then sealed, evacuated, and heated to a temperature at which the cadmium constituent will reduce the silver oxide and be converted to cadmium oxide. In this scheme the silver oxide serves as a source of oxygen and the quantity of silver oxide is coordinated with the quantity of cadmium present so that during processing the silver oxide is completely reduced and the cadmium is completely oxidized.

The sixth method parallels the fifth except that pure silver powder is also present. The fifth and sixth methods produce micro structures which contain regions of pure silver for improved brazing as previously described with respect to methods three and four.

The seventh processing scheme employs cadmium oxide powder, silver powder, and preoxidized nickel powder which are all blended and compacted. The seventh scheme is less desirable because the cadmium oxide particles will be coarser and less effective in dispersion strengthening than the cadmium oxide produced by internal oxidation in the previous processing schemes.

All of the processing schemes involve the use of preoxidized nickel powder wherein the nickel powder has a surrounding oxide layer which prevents the interaction of the nickel with the silver. The nickel powder oxidation parameters are not particularly critical although it is desirable to perform the oxidation step under conditions sufficiently vigorous to insure formation of a complete oxide layer, but insufficient to produce an overly thick or brittle oxide film. For 2 micron diameter nickel powder, a 40 minute exposure at 800° F. in still air converts 2% of the nickel to nickel oxide producing an oxide thickness of 0.05–0.1 micron. In general, I believe that at least about 500Å but no more than about 0.25 micron of surface nickel oxide should be developed.

Contacts produced by prior art techniques by powder metallurgy techniques have suffered because the resultant product was not one hundred percent dense. The classic processing techniques involving only silver and cadmium or cadmium oxide, or silver and nickel produced 5–10 volume percent porosity under the hot pressing and sintering conditions employed. U.S. Pat. No. 3,969,112 describes the addition of sintering aids such as sodium and potassium in small quantities to enhance sintering. While very effective in enhancing sintering such sintering aids have been shown to produce detrimental effects in certain areas of sintered contact performance especially in arc restriking after contact separation. Of course sintering aids are not excluded from use in fabrication of the invention contacts.

A desired feature of the present invention is the use of pure silver, cadmium/cadmium oxide and nickel constituents without the use of sintering aids. The invention process allows the use of such materials without sintering aids but produces contact material densities in excess of 99.9% of theoretical. This is accomplished through use of hot isostatic pressing, a process which has previously been applied to high temperature material components such as gas turbine engine hardware. In the hot isostatic pressing process the material to be densified is encased in a soft metal can or a vitreous glass container which is soft and flexible under processing conditions and the can is evacuated to produce an extremely low gas content prior to sealing. The sealed canned material is placed in a retort and heated to temperatures in excess of the softening or recrystallization temperature of the material while a high pressure gas surrounds the container exerting force on the container. Under these conditions over a period of time the gas pressure causes creep flow of the material, substantially eliminating all voids. The result is fully dense material.

Hot isostatic pressing causes less metal deformation than other compaction techniques (i.e. extrusion) for the same density (or porosity). This may be significant since hot isostatic pressing compaction is less likely to rupture the protective nickel oxide layer surrounding the nickel particles.

In the case of the present invention materials hot isostatic pressing at a temperature of about 1600° F. and an applied gas pressure of 15 ksi and a time period of 2 hours has proven to be useful processing conditions, producing fully dense contact materials.

I have used both nickel cans and vitreous ceramic cans to contain powder to be densified. I prefer to use nickel because it does not interact with the silver material and can be easily removed from the densified compact. The ceramic containers present the potential for contamination of a compact during the HIPping process.

The invention will be better understood by reference to the following illustrative examples.

EXAMPLE 27.33 wt. % pure silver powder (-325 mesh) was mixed with 66.67 wt. % internally oxidized silver-cadmium oxide shot (1–2 mm dia.) and 6 % oxidized nickel powder (2 microns dia.). The cadmium content of the silver-cadmium shot prior to oxidation was about 9%. The silver-cadmium shot internal oxidation was carried out at 1400° F. for 10 minutes in air. The 2 microns nickel powder had been preoxidized at 800°F. for 40 minutes in still air. The overall cadmium oxide content and nickel contents were 6 wt. % and 6 wt. % respectively.

This powder blend was encased in a vitreous container and HIPped at 1600° F., at a pressure of 15 KSI for a time of 2 hours.

The FIGURE is a 500X photomicrograph of the resultant material. Two types of large grains are visible. The pure silver grains are relatively featureless while the silver-cadmium oxide grains show fine black internal particles of cadmium oxide. The preoxidized nickel is seen in the grain boundaries as fine particles with dark boundaries.

The resultant material was fabricated into electrical contacts and were tested under make-break conditions of 240 volts, 150 make amps/30 break amps (60 cycles). Also tested under the same conditions were conventional silver—12% cadmium oxide contacts. The contacts were of the same size and geometry.

The prior art contact lasted for 10,000 cycles at which time the contact material had been completely consumed.

The invention contacts welded together at 800 cycles (analysis showed this to be the result of contamination from the vitreous container) testing was continued and, after 77,000 cycles about 80% of the contact material remained. By rough extrapolation the invention contact material shows the promise of a 38.5X life advantage under these test conditions.

Although this invention has been shown and described with respect to detailed embodiments thereof, it will be understood by those skilled in the art that various changes in form and detail thereof may be made without departing from the spirit and scope of the claimed invention.

I claim:

1. An electrical contact material consisting essentially of 4 to 15 wt. % cadmium oxide as dispersed particles 2 to 8 wt. % nickel, said nickel being present as discrete particles surrounded by nickel oxide, balance essentially silver.

2. A material as in claim 1 which contains regions of pure silver, free from cadmium oxide particles.

3. A material as in claim 1 wherein the cadmium oxide results from the internal oxidation of silver-cadmium alloy material.

4. A material as in claim 1 wherein the cadmium oxide results from the oxidation of free cadmium and has a particle size of 0.2 to 2 microns.

* * * * *